United States Patent [19]

Ginsburg et al.

[11] 4,314,382

[45] Feb. 9, 1982

[54] HINGE FOR TOILET SEAT AND LID

[75] Inventors: Milton Ginsburg, 1201 Sandringham Rd., Bala Cynwyd, Pa. 19004; William J. Lux, Holland, Pa.

[73] Assignee: Milton Ginsburg, Bala Cynwyd, Pa.

[21] Appl. No.: 176,285

[22] Filed: Aug. 8, 1980

[51] Int. Cl.[3] ..... A47K 13/12

[52] U.S. Cl. ..... 4/236; 4/240

[58] Field of Search ..... 4/234, 236, 240, 234

[56] References Cited

U.S. PATENT DOCUMENTS

| | | | |
|---|---|---|---|
| 3,557,393 | 1/1971 | Waldon | 4/236 |
| 3,590,401 | 7/1971 | Brown | 4/236 |
| 3,608,100 | 9/1971 | Trost | 4/236 |
| 3,613,129 | 10/1971 | Blount | 4/236 |
| 3,670,441 | 6/1972 | Blount | 4/236 |
| 3,699,614 | 10/1972 | Stairs | 4/236 |
| 3,790,969 | 2/1974 | Waldon | 4/236 |
| 3,805,306 | 4/1974 | Stairs | 4/236 |

FOREIGN PATENT DOCUMENTS

| | | | |
|---|---|---|---|
| 2020350 | 11/1979 | United Kingdom | 4/240 |

*Primary Examiner*—Henry K. Artis
*Attorney, Agent, or Firm*—Paul & Paul

[57] ABSTRACT

A composite hinge is provided for the seat and the lid of a cushioned toilet seat. The hinge has three arms or leaves, (1) a bowl leaf adapted to be secured as by bolt to the rear of the porcelain bowl, (2) a forwardly extending arm or seat leaf adapted to be secured to the underside of the seat at the rearward end thereof, and (3) a second forwardly extending arm or lid leaf adapted to be secured to the underside of the lid at the rearward end thereof. The pivot point of the lid leaf is adjustable automatically relative to the seat leaf, thereby to accomodate the lid to cushioned toilet seats having different cushion thicknesses. The seat leaf is adjustable automatically in the vertical direction to accommodate the seat to bumpers of different thickness. The composite hinge is so designed that there is no stress on the hinge pins. This design, referred to herein as "the floating design" is achieved by slots in a pair of vertical uprights which are an integral part of the bowl leaf, and by a single slot in the lid leaf.

3 Claims, 5 Drawing Figures

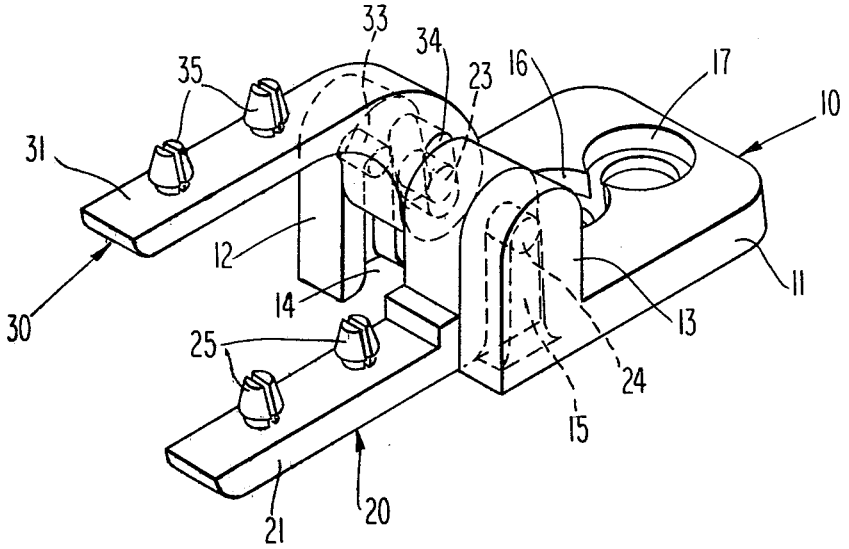
Fig. 1
Fig. 2
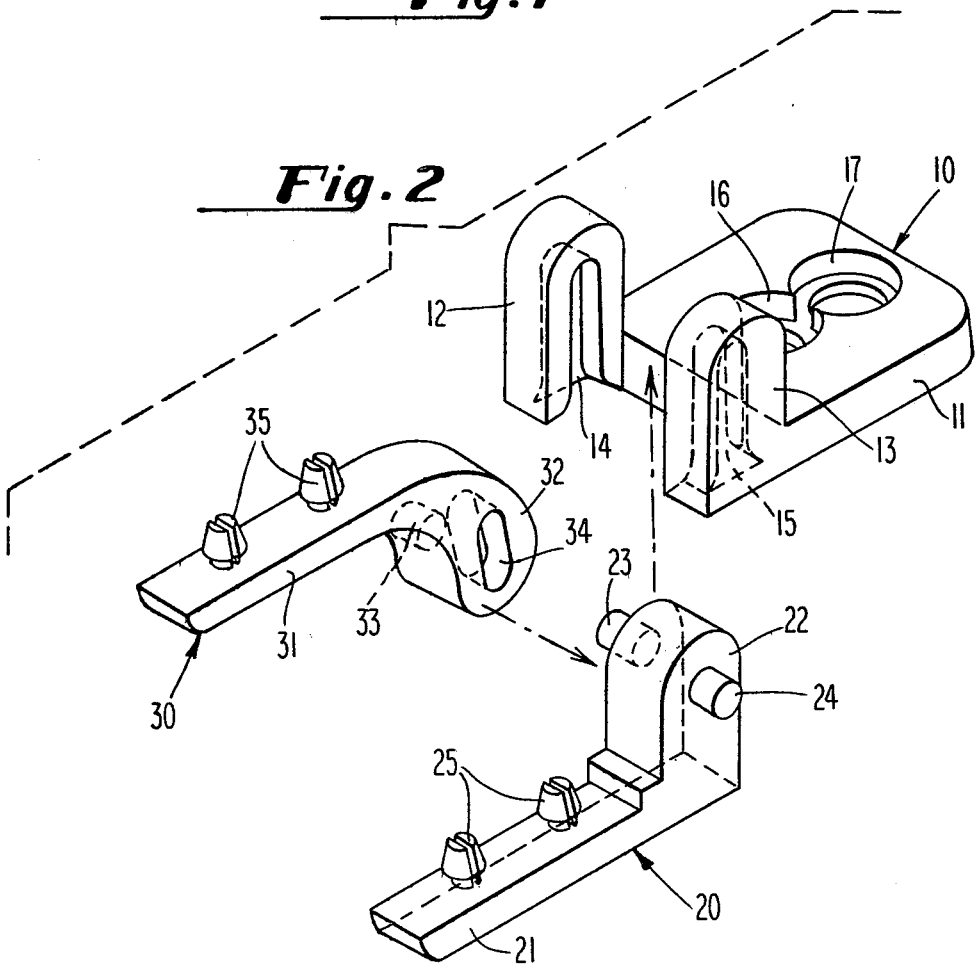

HINGE FOR TOILET SEAT AND LID

BACKGROUND OF THE INVENTION

The invention relates to cushioned toilet seats.

More particularly, the invention relates to a composite hinge having three arms or leaves, one each for attachment to the porcelain bowl, to the cushioned toilet seat, and to the lid.

Cushioned toilet seats have become very popular. A typical cushioned toilet seat comprises a rigid annulus of wood or plastic and an annular cushion of foam plastic which rests on and is supported by the rigid annular support member, both being encased in a vinyl film of attractive design which tightly envelops the foam and rigid support members. The foam cushion may be convex or frusto-convex, and its height may vary, as, for example, from one inch or less to two inches or more.

SUMMARY OF THE INVENTION

A principal object of the present invention is to provide a composite hinge, preferably of molded plastic component parts, having arms or leaves adapted to be attached to the porcelain bowl, to the foam cushioned toilet seat, and to the lid.

Another object is to provide a hinge of the type described above adapted to accomodate to foamed cushioned seats of different thickness.

Another object is to provide a hinge, of the type indicated above, which is adapted for easy and ready attachment to the bowl, to the foam cushioned seat, and to the lid.

Another object is to provide a composite hinge of the type indicated above in which there is no stress on the hinge pins during raising and lowering of the seat and/or lid.

Another object is to provide a composite hinge of the type indicated above which is adapted to be placed in at least two positions on the porcelain bowl, a rearward position, and a forward position, the forward position being used when necessary to assure that the lid and seat, when raised, will stay in their raised positions.

BRIEF DESCRIPTION OF THE DRAWINGS

FIG. 1 is a perspective view of the composite hinge of the present invention.

FIG. 2 is an exploded view of the hinge of FIG. 1.

DETAILED DESCRIPTION OF THE PREFERRED EMBODIMENTS

Referring now to FIG. 1, there is shown a composite hinge according to the present invention which comprises a rear arm or leaf 10 adapted to be attached to the toilet bowl, a lower forwardly extending arm or leaf 20 adapted to be attached to the underside of the cushioned toilet seat at the rearward end thereof, and a forwardly extending upper arm or leaf 30 adapted to be attached to the underside of the toilet seat lid at the rearward end thereof.

Figure 4:
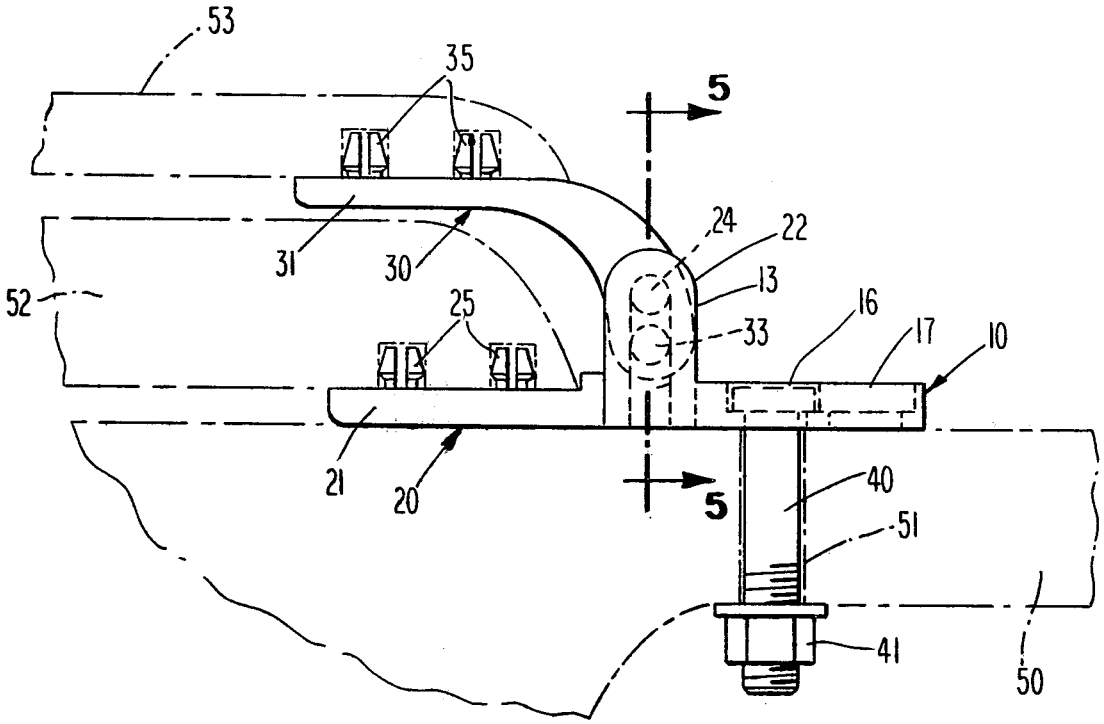
FIG. 4 is an elevational view, in section, looking along the line 4—4 of FIG. 3.

As seen more clearly in the exploded view of FIG. 2, the lower forwardly extending arm or seat leaf 20 has a vertical upright portion 22 at its rearward end from which extend, in opposing directions, a pair of hinge pins 23,24. The forwardly extending portion 21 of the seat leaf 20 has a pair of split compressible prongs or studs 25 which are adapted to be press fitted into holes formed or drilled in the undersurface of the seat 52, as seen in FIG. 4.

The lid leaf 30 has, at its rearward end, a downwardly extending portion 32 having a hinge pin 33 projecting from the one side thereof which is more remote from the seat leaf 20, and having an elongated slot 34 in the sidewall which is adjacent to the upright portion 22 of the seat leaf 20. Slot 34 is adapted to receive the hinge pin 23 of the seat leaf 20. The forwardly extending portion 31 of the lid leaf 30 has a pair of split compressible prongs or studs 35 adapted to be press fitted into holes drilled or formed in the undersurface of the lid 53, as seen in FIG. 4.

The bowl leaf 10 has a pair of uprights 12 and 13 at its forward end having open ended slots 14,15 which face each other and which are adapted to receive the hinge pins 33 and 24.

When lid leaf 30 and seat leaf 20 are interlocked, as shown in perspective in FIG. 1, pin 23 projects into slot 34. The interlocked lid leaf 30 and seat leaf 20 are then insertable into the open-ended sockets 14,15 with slot 14 receiving pin 33 and slot 15 receiving pin 24.

For a reason which will be explained, bowl leaf 10 is provided with a pair of bolt holes 16,17, one of which is rearward of the other. In some toilet designs and installations, the position of the water tank, relative to the location of the hinge pivot points of the toilet seat and lid, is such that when the lid and seat are raised, the seat does not pass through the vertical plane to an over-the-center position and, as a result, the seat does not remain in the raised position, but instead falls back down. This problem may be particularly troublesome in the case of a cushioned toilet seat. The additional thickness of the cushion may prevent the seat, when raised, from passing through the vertical plane to the over-the-center position. In such case, the rearward bolt hole 17 is used, rather than the forward bolt hole 16. Use of the rearward bolt hole 17 moves forward to the location of the hinge or pivot axis of the toilet seat and lid relative to the water tank, thereby enabling the raised toilet seat to pass through the vertical plane to an over-the-center position, thereby enabling the seat and lid to remain in raised position.

Figure 3:
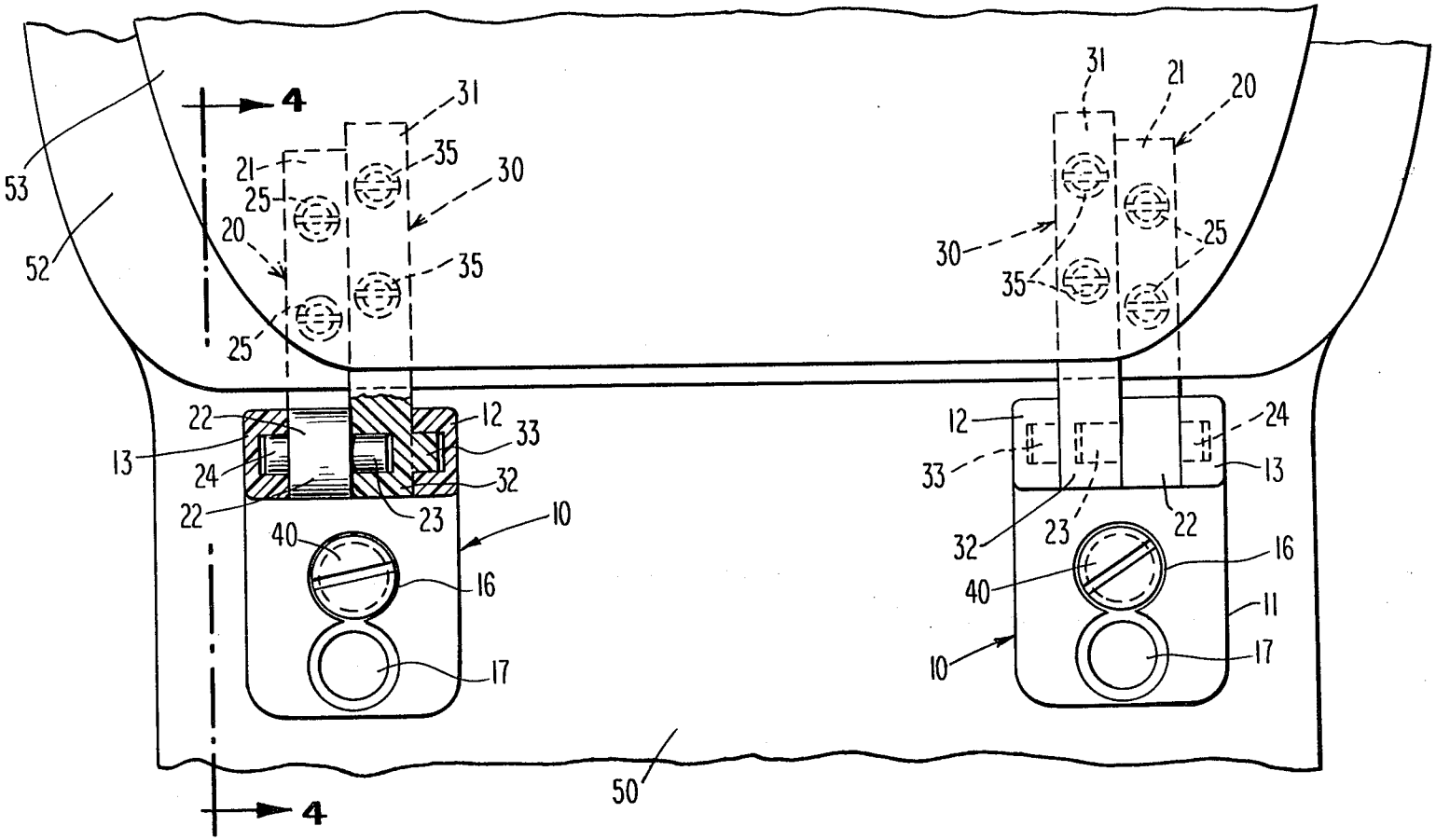
FIG. 3 is a top plan view, showing a pair of hinges of the type provided by the present invention attached to the porcelain bowl, to the seat, and to the lid.

FIGS. 3 and 4 show a pair of composite hinges of the type just described, pivotally securing a cushioned toilet seat 52 and lid 53 to a toilet bowl 50. In FIGS. 3 and 4 bolt 40 is shown inserted through the forward bolt hole 16 of the hinge into the hole 51 of the toilet bowl 50 and secured to the toilet bowl by the nut 41.

Figure 5:
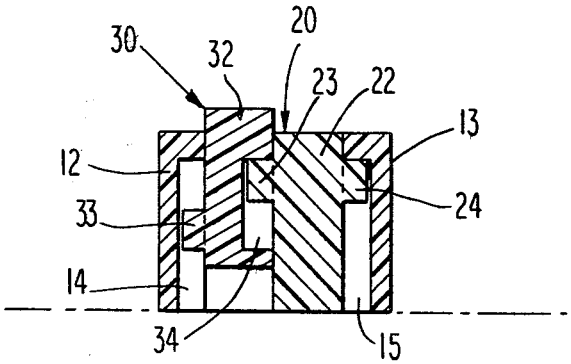
FIG. 5 is an elevational view, in section, looking along the line 5—5 of FIG. 4.

In FIG. 4, and as seen in section in FIG. 5, the cushioned toilet seat 52 is shown to be of relatively low height so that lid leaf 30 is at its lowermost position, with pin 23 of seat leaf 20 being at the uppermost part of slot 34. When the seat 53 is pivotally raised, the hinge-pin support 32 tends to rise. Pin 33 moves upwardly in slot 14, and slot 34 moves upwardly relatively to pin 23, so that when lid 53 reaches its fully raised position, pin 33 is in alignment with pins 23 and 24.

When the lid 53 is returned pivotally downwardly from its fully raised position to its lower position, an action which is the reverse of that just described takes place. That is to say, pin 33 moves downwardly in slot 14 and pin 23 moves upwardly relative to the slot 34, to the position illustrated in FIGS. 4 and 5. In other words, the positions of pins 33 and 23, when the lid is in its lowered position, is as shown in cross section in FIG. 5.

The height or thickness of the forwardly-extending arm 21 of seat leaf 20 is designed to be equal to that of the height or thickness of the bumpers (not shown) which are ordinarily provided on the undersurface of the toilet seat. In some cases, it may happen that the height of the bumper is greater than the height of arm 21 of the seat leaf 20. In such cases, when weight is placed on the cushioned toilet seat, the seat leaf 20 will move downwardly, with pins 23 and 24 moving downwardly in slots 34 and 15, respectively, until the undersurface of arm 21 of seat leaf 20 rests on the porcelain bowl 50. This movement avoids any stress being placed on hinge pins 23,24.

What is claimed is:

1. A hinge for a toilet seat and lid, said hinge comprising:
   a. a bowl leaf;
   b. a seat leaf;
   c. a lid leaf;
   d. said bowl leaf having
      d-1 a base;
      d-2 a pair of spaced-apart socket portions extending upwardly from the forward end of said base;
   e. said seat leaf having
      e-1 an elongated base;
      e-2 at least two split compressible studs projecting upwardly from a forward end of said base;
      e-3 a hinge-pin support extending upwardly from the rearward end of said base;
      e-4 a pair of hinge pins extending laterally in opposing directions from said hinge-pin support;
   f. said lid leaf having;
      f-1 an elongated base;
      f-2 at least two split compressible studs projecting upwardly from a forward portion of said base;
      f-3 a hinge-pin support extending downwardly from the rearward end of said base.

2. A composite hinge for a cushioned toilet seat and lid, said hinge comprising:
   a. a bowl arm;
   b. a seat arm;
   c. a lid arm;
   d. said bowl arm having
      d-1 a base;
      d-2 a pair of spaced-apart uprights at the the forward end of said base;
   e. said seat arm having
      e-1 an elongated portion;
      e-2 an upright at the rearward end of said elongated portion;
      e-3 a pair of hinge pins extending laterally in opposing directions from said upright;
   f. said lid arm having;
      f-1 an elongated portion;
      f-2 a dependent portion at the rearward end of said elongated portion;
      f-3 a hinge pin extending laterally from one sidewall of said dependent portion and a slot in the opposite sidewall for receiving one of the hinge pins of said seat arm.

3. A composite hinge according to claim 2 wherein:
   a. said elongated portion of said seat arm and said elongated portion of said lid arm are each provided with upwardly-extending split prongs adapted to be press fitted into recesses in said seat and lid, respectively, to permit quick attachment of said hinge to said seat and to said lid;
   f-4 a hinge pin extending laterally from one sidewall of said support and a slot in the opposite sidewall for receiving one of the hinge pins of said seat leaf.

* * * * *